US008462083B2

(12) United States Patent
Ahn

(10) Patent No.: US 8,462,083 B2
(45) Date of Patent: Jun. 11, 2013

(54) INVERTER AND DISPLAY DEVICE INCLUDING THE SAME

(75) Inventor: Jung-Keun Ahn, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 741 days.

(21) Appl. No.: 12/422,861

(22) Filed: Apr. 13, 2009

(65) Prior Publication Data

US 2009/0256784 A1 Oct. 15, 2009

(30) Foreign Application Priority Data

Apr. 14, 2008 (KR) ..... 10-2008-0034140

(51) Int. Cl.
*G09G 3/30* (2006.01)

(52) U.S. Cl.
USPC ..... 345/76; 345/36; 345/100; 345/204

(58) Field of Classification Search
CPC ..... G09G 3/30; G09G 3/12; G09G 3/36
USPC ..... 345/76, 100, 36, 204; 327/536
See application file for complete search history.

(56) References Cited

U.S. PATENT DOCUMENTS 7,982,704 B2 * 7/2011 Shin ..... 345/100
2004/0239655 A1 * 12/2004 Tani et al. ..... 345/204
2005/0156863 A1 * 7/2005 Kim ..... 345/100
2007/0103389 A1 * 5/2007 Shin ..... 345/36
2008/0012818 A1 * 1/2008 Lee et al. ..... 345/100
2008/0150844 A1 * 6/2008 Choi ..... 345/76

FOREIGN PATENT DOCUMENTS

JP 09-246936 9/1997
JP 2005-192081 7/2005
KR 2000-0045345 7/2000
KR 1020040012133 A 2/2004
KR 10-0505371 8/2005
KR 10-2007-0088563 8/2007

OTHER PUBLICATIONS

Korean Office action dated Aug. 10, 2009 for Application No. 10-2008-0034140.
Jung, et al., "A New Low-Power pMOS Poly-Si Inverter for AMDs", IEEE Electron Device Letters, vol. 26, No. 1, Jan. 2005, pp. 23-25.

* cited by examiner

*Primary Examiner* — Thuy Pardo
(74) *Attorney, Agent, or Firm* — Christie, Parker & Hale, LLP

(57) ABSTRACT

An inverter includes a first PMOS transistor having a gate electrode coupled to a first input port, a first electrode coupled to a first node and a second electrode coupled to the gate electrode or a second power source; a second PMOS transistor having a gate electrode coupled to the first input port, and first and second electrodes coupled respectively to a first power source and an output port; a third PMOS transistor having a gate electrode coupled to the first node, first and second electrodes coupled respectively to the output port and a second input port; and a capacitor coupled between the first node and the output port.

6 Claims, 4 Drawing Sheets

INVERTER AND DISPLAY DEVICE INCLUDING THE SAME

CROSS-REFERENCE TO RELATED APPLICATION

This application claims priority to and the benefit of Korean Patent Application No. 10-2008-0034140, filed on Apr. 14, 2008, in the Korean Intellectual Property Office, the entire content of which is incorporated herein by reference.

BACKGROUND

1. Field of the Invention

The present invention relates to an inverter, and more particularly to an inverter and a display device including the same.

2. Discussion of Related Art

There have been attempts to integrate a display panel and a driver circuit for driving the display panel in flat panel displays such as an active matrix liquid crystal display or an organic light emitting display.

To date, technologies for the integration of the driver circuit have been mainly focused on designing circuits using CMOS type polysilicon thin film transistors. However, a large number of masks are required to manufacture N-type and P-type transistors at the same time, and additional processes are necessary to adjust each of their threshold voltages. This results in a reduction of process yield and an increase in the process cost, as well as a degradation in the reliability of driver circuits.

In general, it has been known that characteristics of the N-type thin film transistor are more seriously degraded than the P-type thin film transistor since the N-type thin film transistor may be thermally damaged by hot carriers while being driven. Therefore, it is desirable to prevent the driver circuit unit from being degraded because of the N-type elements when the driver circuit unit is designed as a CMOS circuit using polysilicon thin film transistors. For this purpose, an LDD process is additionally used.

Accordingly, additional processes are used to ensure the stability of driving these circuits, and the LDD process itself functions as a factor that may significantly reduce the process yield. Therefore, it may be desirable to design circuits without the use of N-type polysilicon thin film transistors.

SUMMARY OF THE INVENTION

Accordingly, exemplary embodiments according to the present invention are provided to solve such drawbacks of in the related art. An aspect of an exemplary embodiment according to the present invention is to provide an inverter having simplified manufacturing process and improved driving characteristics. According to one embodiment, an inverter includes three PMOS thin film transistors (TFTs) and one capacitor. Such inverter is designed using polysilicon (Poly-Si) thin film transistors.

Also, another aspect of the present invention is to provide a display device having the inverter according to embodiments of the present invention.

In an exemplary embodiment according to the present invention, an inverter includes a first PMOS transistor having a gate electrode coupled to a first input port, a first electrode coupled to a first node and a second electrode coupled to the gate electrode or a second power source; a second PMOS transistor having a gate electrode coupled to the first input port, and first and second electrodes coupled respectively to a first power source and an output port; a third PMOS transistor having a gate electrode coupled to the first node, first and second electrodes coupled respectively to the output port and a second input port; and a capacitor coupled between the first node and the output port.

An inversed signal of the signal inputted to the first input port may be inputted to the second input port, and the first power source may have the same voltage as a high-level voltage out of the voltages inputted to the first input port or the second input port and the second power source may have the same voltage as a low-level voltage out of the voltages inputted to the first input port or the second input port.

In another exemplary embodiment according to the present invention, a display device includes a display unit, a scan driver, a data driver and a controller, wherein the scan driver includes a shift register for sequentially supplying a signal supplied to scan lines; a level shifter for converting the signal received from the shift register to a predetermined voltage level and supplying the converted signal; and a buffer for outputting the signal received from the level shifter to each of the scan lines, wherein the buffer includes a plurality of inverters, each of which includes three PMOS transistors and one capacitor.

An inverter according to exemplary embodiments of the present invention may simplify the manufacturing process since inverter circuits are realized using PMOS transistors, and improve its driving characteristics since its operation principle is simple.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
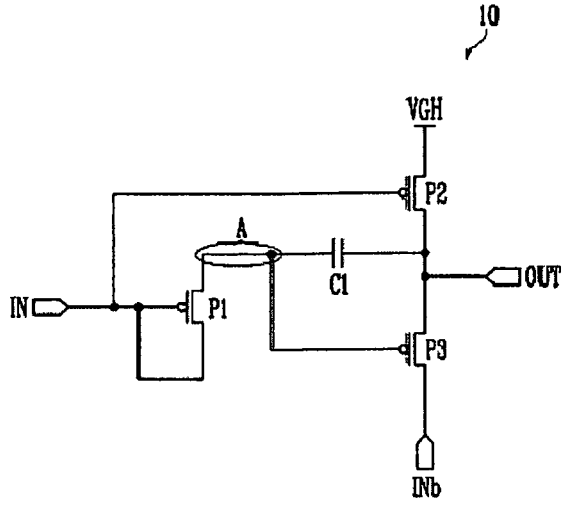
FIG. 1 is a circuit diagram showing a configuration of an inverter according to a first exemplary embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

FIG. 1 is a circuit diagram showing a configuration of an inverter according to a first exemplary embodiment of the present invention.

Referring to FIG. 1, the inverter according to the first exemplary embodiment of the present invention includes a first PMOS transistor P1 having a gate electrode coupled to a first input port IN, a first electrode coupled to a first node A and a second electrode coupled to the gate electrode; a second PMOS transistor P2 having a gate electrode coupled to the first input port IN and first and second electrodes coupled respectively to a first power source VGH and an output port OUT; a third PMOS transistor P3 having a gate electrode coupled to the first node A and first and second electrodes coupled respectively to the output port OUT and a second input port INb; and a capacitor C1 coupled between the first node A and the output port OUT.

As shown in FIG. 1, an inversed signal of the signal inputted to the first input port IN is inputted to the second input port INb.

Figure 2:
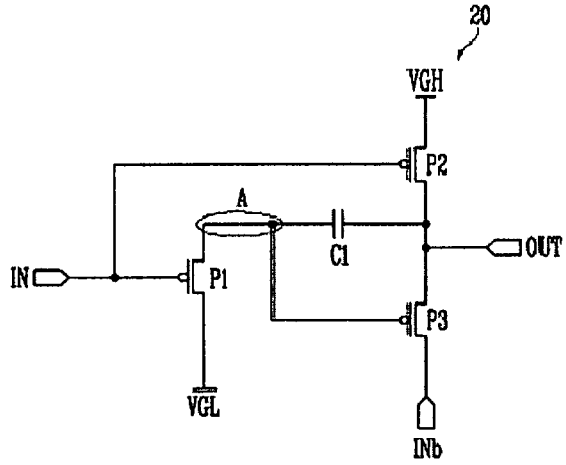
FIG. 2 is a circuit diagram showing a configuration of an inverter according to a second exemplary embodiment of the present invention.

FIG. 2 is a circuit diagram showing a configuration of an inverter according to a second exemplary embodiment of the present invention.

Referring to FIG. 2, the inverter according to the second exemplary embodiment of the present invention includes a first PMOS transistor P1 having a gate electrode coupled to a first input port IN, a first electrode coupled to a first node A and a second electrode coupled to a second power source VGL; a second PMOS transistor P2 having a gate electrode coupled to the first input port IN and first and second electrodes coupled respectively to a first power source VGH and an output port OUT; a third PMOS transistor P3 having a gate electrode coupled to the first node A and first and second electrodes coupled respectively to the output port OUT and a second input port (INb); and a capacitor C1 coupled between the first node A and the output port OUT.

It can be seen by comparing the second exemplary embodiment of the present invention with the first exemplary embodiment, the inverter of the second exemplary embodiment has substantially the same structure as the first exemplary embodiment, except that the second electrode of the first PMOS transistor P1 is not diode-coupled, but is coupled to the second power source VGL.

As shown in FIG. 2, an inversed signal of the signal inputted to the first input port IN is inputted to the second input port INb.

Figure 3:
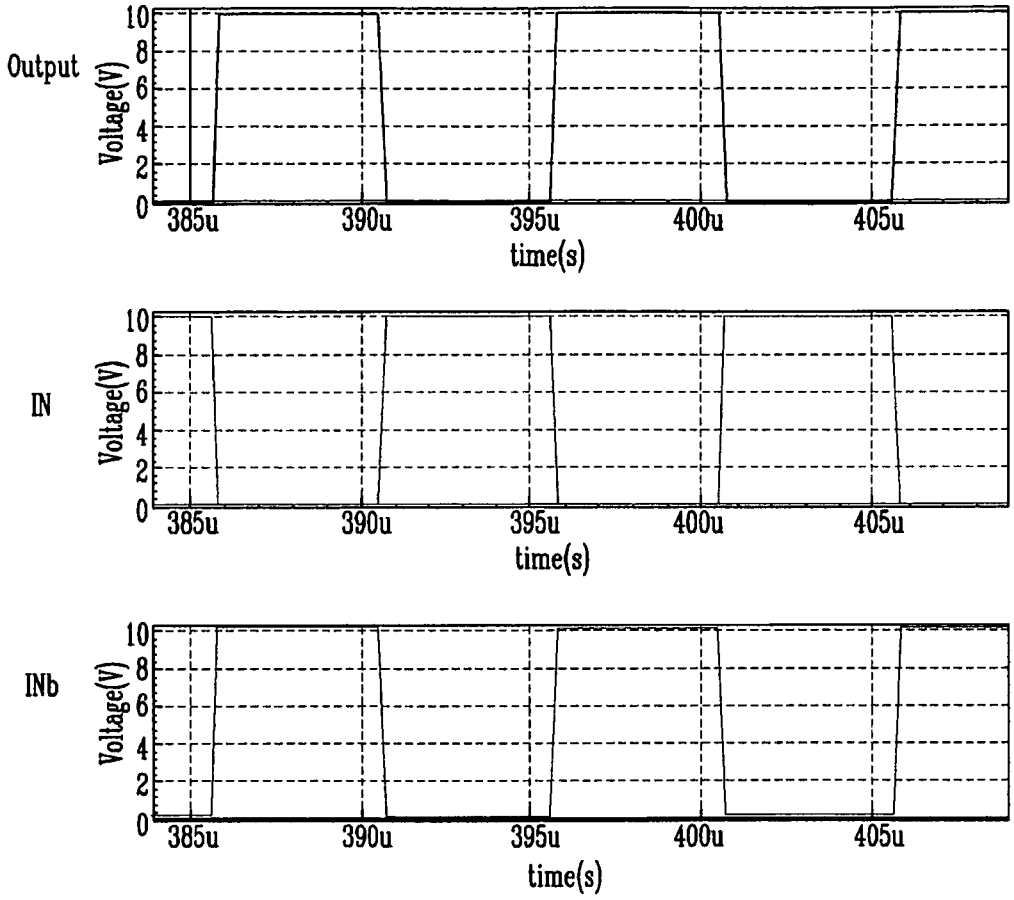
FIG. 3 is a graph showing simulation results according to the configurations of the inverters shown in FIGS. 1 and 2.

FIG. 3 is a graph showing simulation results according to the configurations of the inverters shown in FIGS. 1 and 2.

The first power source VGH has a voltage of 10V, the second power source VGL has a voltage of 0V, the signal inputted to the first input port IN has a voltage of 0V~10V, and the signal inputted to the second input port INb is an opposite signal, for example an inversed signal (or inverted signal), of the signal inputted to the first input port IN.

Hereinafter, an operation of the inverter according to exemplary embodiments of the present invention will be described in more detail with reference to FIGS. 1 to 3.

First, when 0V is inputted to the first input port IN and 10V is inputted to the second input port INb, a voltage of 0V is applied to the gate electrodes of the transistors P1 and P2, and therefore the transistors P1 and P2 are turned on.

According to the first exemplary embodiment of FIG. 1, when the transistor P1 is turned on by applying 0V to the first input port IN as an input signal, the first node A has a voltage of 0V+ the threshold voltage $V_{thP1}$ since the first transistor P1 is diode-coupled. According to the second exemplary embodiment of FIG. 2, when the first transistor P1 is turned on, the first node A has a voltage of VGL of a second power source+the threshold voltage $V_{thP1}$ since the second electrode of the first transistor P1 is coupled to the second power source VGL. By way of example, the second power source VGL may supply a voltage having 1V.

According to the first exemplary embodiment of FIG. 1, when the second transistor P2 is turned on, the output port OUT has a voltage of about 10V, and the voltages of about 0V (i.e., the threshold voltage $V_{thP1}$ of the first transistor P1) and about 10V are applied respectively to ends of the capacitor C1. Here, a voltage of about 10V is charged in the capacitor (C1).

At this time, the third transistor P3 is turned on since the gate electrode of the third transistor P3 is coupled to the gate electrode of the first transistor P1. However, an electrode coupled to the second electrode, for example the second input port INb, of the third transistor P3 has substantially the same voltage of 10V as an electrode coupled to the first electrode, for example the output port OUT, of the third transistor P3. Therefore, there is little or no leakage current in the P3, and also a rising time is short since a voltage is charged by the third transistor P3 in addition to the capacitor C1. Accordingly, a voltage of about 10V is outputted to the output port OUT.

That is to say, the voltage of 0V inputted to the first input port IN is inverted to 10V and then outputted through the output port OUT. This result is confirmed from the graph as shown in FIG. 3.

Next, when a voltage of 10V is inputted to the first input port IN, and a voltage of 0V is inputted to the second input port INb, the transistors P1 and P2 are turned off as the voltage of 10V is applied to the gate electrodes of the transistors P1 and P2.

However, the third transistor P3 is turned on by the voltage charged in the capacitor C1, and the gate electrode of the third transistor P3 becomes a floating state when the first transistor P1 is turned off.

When the third transistor P3 is turned on and the gate electrode of the third transistor P3 becomes a floating state as described above, a voltage of the output port OUT coupled to the first electrode of the third transistor P3 is dropped to a lower voltage due to the voltage of the second input port INb coupled to the second electrode of the third transistor P3 (discharging). The gate electrode of the third transistor P3 is dropped to a voltage that is much lower than the threshold voltage $V_{thP1}$ of the first transistor P1 (i.e., 0V+P1) due to the coupling effect of the capacitor C1, and therefore the third transistor P3 is completely turned on.

Therefore, a voltage of the output port OUT is dropped to 0V that is a voltage of the second input port INb.

As a result, the voltage of 10V inputted to the first input port IN is inverted to 0V, and then outputted through the output port OUT. This result is confirmed from the graph as shown in FIG. 3.

Accordingly, it can be seen that the inverter circuits shown in FIGS. 1 and 2, respectively, operate normally.

Figure 4:
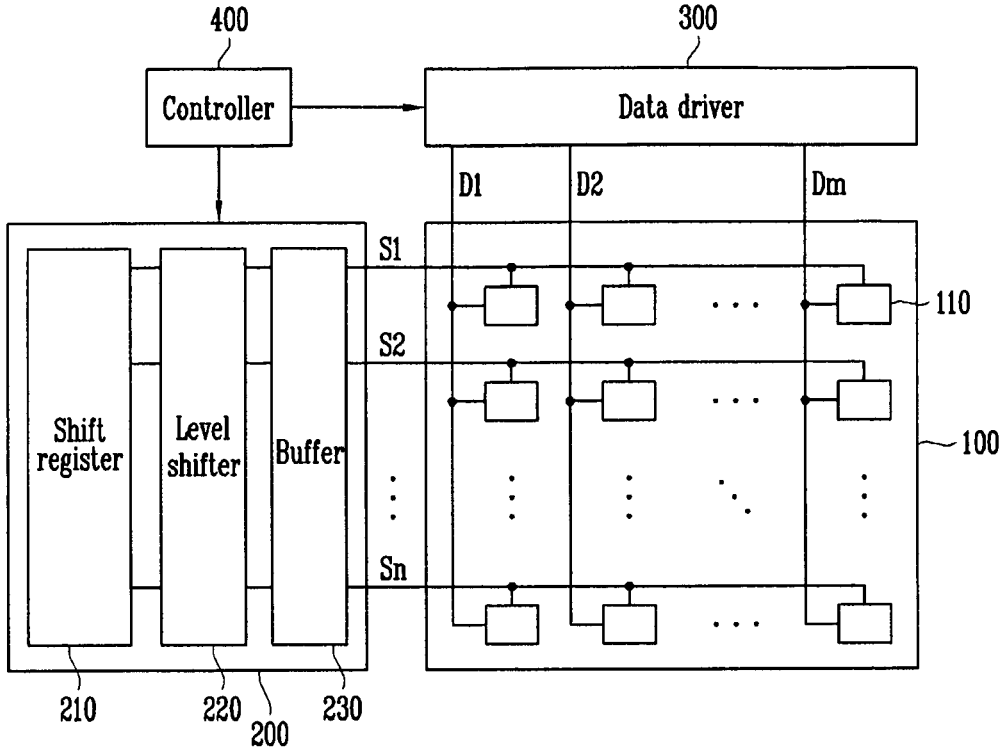
FIG. 4 is a block diagram showing a display device having an inverter according to one exemplary embodiment of the present invention.

FIG. 4 is a block diagram showing a display device including an inverter according to an exemplary embodiment of the present invention.

Referring to FIG. 4, the display device according to an exemplary embodiment of the present invention includes a display unit 100, a scan driver 200, a data driver 300, and a controller 400.

The display unit 100 includes a plurality of scan lines (S1, S2, . . . Sn), a plurality of data lines (D1, D2, . . . Dm) and a plurality of pixels 110 located at crossing regions of the plurality of scan lines (S1, S2 . . . Sn) and the plurality of data lines (D1, D2, . . . Dm).

Also, the scan driver 200 applies a scan signal to the plurality of scan lines (S1, S2, . . . Sn), and includes a shift register 210, a level shifter 220 and a buffer 230.

The shift register 210 sequentially supplies a signal, which will be supplied to the scan lines, to the level shifter 220. The level shifter 220 converts the signal received from the shift register 210 and converts the signal received from the shift register 210 to a level of voltage to be supplied to the buffer 230 and outputs the converted signal. The buffer 230 supplies the converted signal to the plurality of scan lines (S1, S2, . . . Sn).

Figure 5:
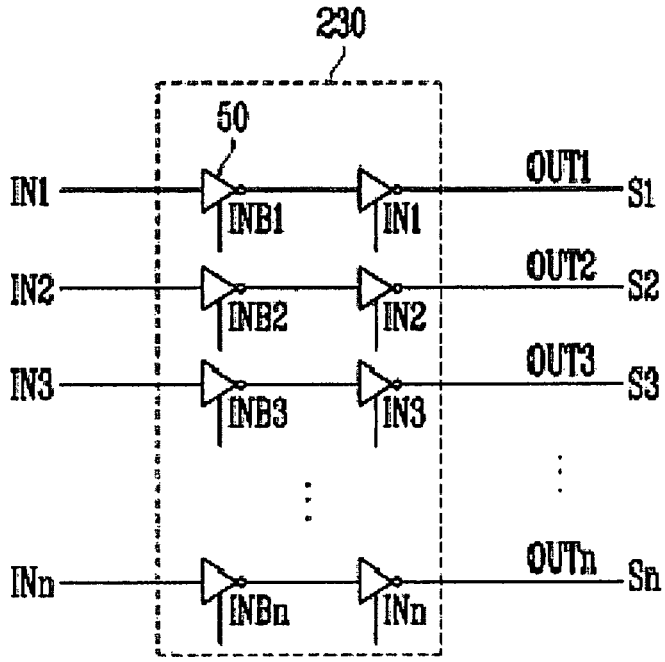
FIG. 5 is a schematic block diagram of a buffer according to one exemplary embodiment of the present invention.

Also, the buffer 230 prevents an operating speed from being reduced due to the load of the display unit 100. A schematic diagram of the buffer 230 is shown in FIG. 5, for example. The inverters 50 may include the inverter 10 of FIG. 1 or the inverter 20 of FIG. 2. When the inverter 50 is the inverter 10, it receives the voltage VGH from the first voltage source. When the inverter 50 is the inverter 20, it receives the voltage VGL from the second voltage source as well as the voltage VGH from the first voltage source.

As shown in FIG. 5, the buffer 230 receives a plurality of inputs IN1 to INn and a plurality of inverted inputs INb1 to INbn, and outputs a plurality of outputs OUT1 to OUTn, which correspond to the scan signals S1 to Sn.

Also, the data driver 300 applies data signals to the plurality of data lines (D1, D2, . . . Dm).

According to one exemplary embodiment, the scan driver 200 and the data driver 300 are directly installed onto a substrate (not shown), and therefore this configuration is called a chip on glass (COG) assembly.

Further, the controller 400 supplies a control signal for driving the scan driver 200 and the data driver 300.

For the display device as described above, for example, the buffer 230 of the scan driver 200 may be composed of a plurality of inverters.

According to exemplary embodiments of the present invention, the manufacturing processes may be simplified and the driving characteristics may be improved by manufacturing all of the transistors used in the inverter as PMOS type transistors. An exemplary configuration of the inverter is substantially the same as the configuration that is described above with reference to FIGS. 1 and 2, and therefore description of the exemplary configuration is omitted.

Also, while an implementation of the PMOS-type inverter is described in reference to its use in the scan driver in this exemplary embodiment, the present invention is not particularly limited thereto. In other words, because the PMOS-type inverters can be basic building blocks of logic gates, the PMOS-type inverters may widely apply to integrated circuits.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An inverter comprising:

a first PMOS transistor having a gate electrode coupled to a first input port, a first electrode coupled to a first node, and a second electrode coupled to the gate electrode or a second power source;

a second PMOS transistor having a gate electrode coupled to the first input port, and first and second electrodes coupled respectively to a first power source and an output port for outputting current exiting the inverter;

a third PMOS transistor having a gate electrode coupled to the first node, first and second electrodes coupled respectively to the output port and a second input port; and a capacitor coupled between the first node and the output port.

2. The inverter according to claim 1, wherein an inversed signal of the signal inputted to the first input port is inputted to the second input port.

3. The inverter according to claim 1, wherein the first power source has the same voltage as a high-level voltage out of the voltages inputted to the first input port or the second input port.

4. The inverter according to claim 1, wherein the second power source has the same voltage as a low-level voltage out of the voltages inputted to the first input port or the second input port.

5. A display device comprising a display unit, a scan driver, a data driver and a controller, wherein the scan driver comprises:

a shift register for sequentially supplying a signal supplied to scan lines;

a level shifter for converting the signal received from the shift register to a predetermined voltage level and supplying the converted signal; and a buffer for outputting the signal received from the level shifter to each of the scan lines, wherein the buffer comprises a plurality of inverters, each of the inverters comprising three PMOS transistors and one capacitor coupled to a gate and an electrode of one of the transistors, wherein the three PMOS transistors and the one capacitor of the inverter comprises:

a first PMOS transistor having a gate electrode coupled to a first input port, a first electrode coupled to a first node, and a second electrode coupled to the gate electrode or a second power source;

a second PMOS transistor having a gate electrode coupled to the first input port, and first and second electrodes coupled respectively to a first power source and an output port for outputting at least a portion of the signal;

a third PMOS transistor having a gate electrode coupled to the first node, first and second electrodes coupled respectively to the output port and a second input port; and a capacitor coupled between the first node and the output port.

6. The display device according to claim 5, wherein an inversed signal of the signal inputted to the first input port is inputted to the second input port.

* * * * *